US012779286B2

(12) United States Patent
Nissilä et al.

(10) Patent No.: US 12,779,286 B2
(45) Date of Patent: Nov. 3, 2026

(54) SYSTEM AND METHOD FOR RECOMMENDING PHYSICAL ROUTINE

(71) Applicant: Summa Finland Oy, Oulu (FI)

(72) Inventors: Juuso Nissilä, Oulu (FI); Jukka Huovinen, Tampere (FI); Tommi Kinnunen, Helsinki (FI); Hannu Kinnunen, Oulu (FI); Marko Mäkinen, Oulu (FI)

(73) Assignee: Summa Finland Oy, Oulu (FI)

( * ) Notice: Subject to any disclaimer, the term of this patent is extended or adjusted under 35 U.S.C. 154(b) by 629 days.

(21) Appl. No.: 18/154,893

(22) Filed: Jan. 16, 2023

(65) Prior Publication Data

US 2023/0226412 A1 Jul. 20, 2023

(30) Foreign Application Priority Data

Jan. 18, 2022 (FI) ..... 20225039

(51) Int. Cl.
*A63B 24/00* (2006.01)

(52) U.S. Cl.
CPC ..... *A63B 24/0075* (2013.01); *A63B 24/0062* (2013.01); *A63B 2220/62* (2013.01); *A63B 2220/80* (2013.01); *A63B 2230/00* (2013.01)

(58) Field of Classification Search
CPC ..... A63B 2220/62; A63B 2220/80; A63B 2230/00; A63B 24/0062; A63B 24/0075;
(Continued)

(56) References Cited

U.S. PATENT DOCUMENTS

2013/0096396 A1 4/2013 Riedel
2015/0359480 A1* 12/2015 Guthrie ..... G09B 19/0038 600/301

(Continued)

FOREIGN PATENT DOCUMENTS

EP 2898826 A1 7/2015
EP 3037993 A1 6/2016
WO 2020096788 A1 5/2020

OTHER PUBLICATIONS

Mugele et al., "Accuracy of training recommendations based on a treadmill multistage incremental exercise test." PLOS ONE, Published Oct. 11, 2018, https://doi.org/10.1371/journal.pone.0204696, 12 pages.

(Continued)

*Primary Examiner* — Amanda K Hulbert
(74) *Attorney, Agent, or Firm* — ZIEGLER IP LAW GROUP, LLC.

(57) ABSTRACT

A system and a method for recommending a physical routine to a person. The system includes a physical sensor, a biochemical sensor and a processing arrangement. The processing arrangement is configured to measure, via the physical sensor, a first intensity and a corresponding first training impulse of a first physical routine, and a second intensity and a corresponding second training impulse of a second physical routine; determine, via the biochemical sensor, a first level of a biochemical marker associated with completion of the first physical routine and a second level of a biochemical marker associated with completion of the second physical routine; calculate a corresponding first response value and a second response value; compare the calculated first response value and the calculated second response value, and recommend one of the first physical routine and the second physical routine for the person based on the comparison.

18 Claims, 4 Drawing Sheets

(58) Field of Classification Search
CPC ..... G16H 20/30; G16H 40/63; G16H 40/67; G16H 50/30; G16H 50/70
See application file for complete search history.

(56) References Cited

U.S. PATENT DOCUMENTS

2016/0328991 A1* 11/2016 Simpson ..... G09B 19/0092
2021/0264604 A1* 8/2021 Divaraniya ..... G06T 7/0016

OTHER PUBLICATIONS

Finnish Patent and Registration Office, Search Report, U.S. Appl. No. 20/225,039, mailed Jul. 15, 2022, 2 pages.

* cited by examiner

SYSTEM AND METHOD FOR RECOMMENDING PHYSICAL ROUTINE

TECHNICAL FIELD

The present disclosure relates, generally, to analyzing various physical routines. More specifically, the present disclosure relates to a system and a method for recommending a physical routine to a person.

BACKGROUND

Physical routines, like exercises, a workout or a training program, physical activities, sports in general include any bodily activity that enhances or maintains physical fitness and overall health and wellness. It (routine/exercise, workout, training, activity) may be performed by a person for various reasons including strengthening muscles and the cardiovascular system, honing athletic skills, weight loss or maintenance, as well as for the purpose of enjoyment. Typically, the evaluation of the effects and compatibility of different physical routines with a person has been done by specialized coaches and physical trainers who recommend the best suited physical routine for the person based on their expertise and evaluation. Such coaches and physical trainers generally provide such results with varying degrees of success, based on heuristics and intuition. Further, this approach is time and labour intensive, and thus expensive. Thus, there exists a need for automation in the process of recommending the best suited physical activity and routine to the user. Furthermore many people struggle on finding which routine/sport/activity is best for them. As an additional problem to finding which routine (selecting one sport over another) is best, it is difficult to know which (training) routine is best within a given/selected sport. For example, should a person run 10 km every day or would 5 km running every day be better. At present, none of the existing techniques or methods provide a way for recommending a physical routine which is suited for the person in comparison to another physical routine.

Therefore, in the light of the foregoing discussion, there still exists a need to overcome the aforementioned drawbacks associated with known techniques for recommending a physical routine to a person.

SUMMARY

The present disclosure seeks to provide a system for recommending a physical routine to a person. The present disclosure also seeks to provide a method for recommending a physical routine to a person. An aim of the present disclosure is to provide a solution that overcomes at least partially the problems encountered in the prior art.

In one aspect, an embodiment of the present disclosure provides a system for recommending a physical routine to a person, comprising:

- a physical sensor configured to measure an intensity of the physical routine;
- a biochemical sensor configured to determine a level of a biochemical marker of the person;
- a processing arrangement configured to:
  - measure, via the physical sensor, a first intensity of a first physical routine performed by the person;
  - determine a first training impulse value corresponding to the first physical routine as performed by the person based, at least in part, on the measured first intensity thereof;

- determine, via the biochemical sensor, a first level of a biochemical marker of the person associated with completion of the first physical routine, as performed by the person;
  - calculate a first response value for the first physical routine based on the determined first training impulse value and the determined first level of the biochemical marker;
  - measure, via the physical sensor, a second intensity of a second physical routine performed by the person;
  - determine a second training impulse value corresponding to the second physical routine as performed by the person based, at least in part, on the measured second intensity thereof;
  - determine, via the biochemical sensor, a second level of a biochemical marker of the person associated with completion of the second physical routine, as performed by the person;
  - calculate a second response value for the second physical routine based on the determined second training impulse value and the determined second level of the biochemical marker;
  - compare the calculated first response value and the calculated second response value; and
  - recommend one of the first physical routine and the second physical routine for the person based on the comparison.

In another aspect, an embodiment of the present disclosure seeks to provide a method for recommending a physical routine to a person, comprising:

- determining a first training impulse value corresponding to a first physical routine performed by the person;
- determining a first level of a biochemical marker of the person associated with completion of the first physical routine, as performed by the person;
- calculating a first response value for the first physical routine based on the determined first training impulse value and the determined first level of the biochemical marker;
- determining a second training impulse value corresponding to a second physical routine performed by the person;
- determining a second level of the biochemical marker of the person associated with completion of the second physical routine, as performed by the person;
- calculating a second response value for the second physical routine based on the determined second training impulse value and the determined second level of the biochemical marker;
- comparing the calculated first response value and the calculated second response value; and
- recommending one of the first physical routine and the second physical routine for the person based on the comparison.

Additional aspects, advantages, features and objects of the present disclosure will be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

DETAILED DESCRIPTION OF EMBODIMENTS

Figure 1:
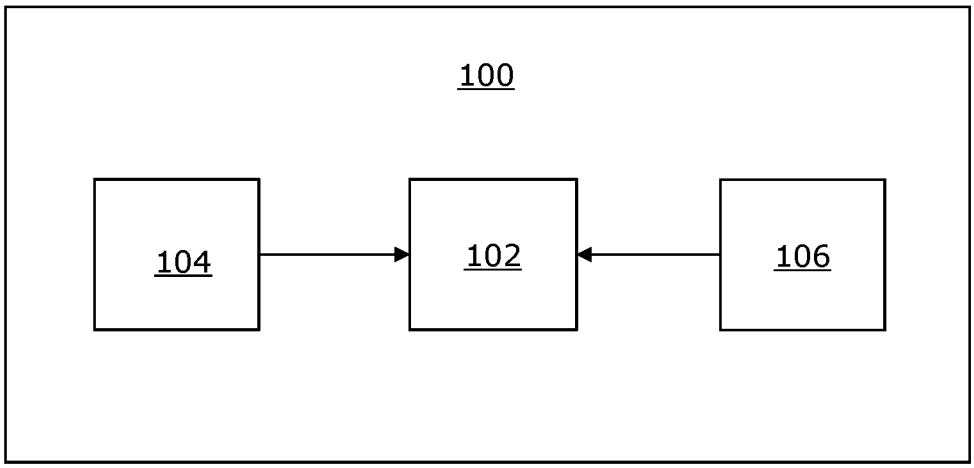
FIG. 1 is a block diagram of a system for recommending a physical routine to a person, in accordance with an embodiment of the present disclosure.

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

In one aspect, an embodiment of the present disclosure seeks to provide a system for recommending a physical routine to a person, comprising:

a physical sensor configured to measure an intensity of the physical routine;

a biochemical sensor configured to determine a level of a biochemical marker of the person;

a processing arrangement configured to:

measure, via the physical sensor, a first intensity of a first physical routine performed by the person;

determine a first training impulse value corresponding to the first physical routine as performed by the person based, at least in part, on the measured first intensity thereof;

determine, via the biochemical sensor, a first level of a biochemical marker of the person associated with completion of the first physical routine, as performed by the person;

calculate a first response value for the first physical routine based on the determined first training impulse value and the determined first level of the biochemical marker;

measure, via the physical sensor, a second intensity of a second physical routine performed by the person;

determine a second training impulse value corresponding to the second physical routine as performed by the person based, at least in part, on the measured second intensity thereof;

determine, via the biochemical sensor, a second level of a biochemical marker of the person associated with completion of the second physical routine, as performed by the person;

calculate a second response value for the second physical routine based on the determined second training impulse value and the determined second level of the biochemical marker;

compare the calculated first response value and the calculated second response value; and recommend one of the first physical routine and the second physical routine for the person based on the comparison.

In another aspect, an embodiment of the present disclosure seeks to provide a method for recommending a physical routine to a person, comprising:

determining a first training impulse value corresponding to a first physical routine performed by the person;

determining a first level of a biochemical marker of the person associated with completion of the first physical routine, as performed by the person;

calculating a first response value for the first physical routine based on the determined first training impulse value and the determined first level of the biochemical marker;

determining a second training impulse value corresponding to a second physical routine performed by the person;

determining a second level of the biochemical marker of the person associated with completion of the second physical routine, as performed by the person;

calculating a second response value for the second physical routine based on the determined second training impulse value and the determined second level of the biochemical marker;

comparing the calculated first response value and the calculated second response value; and recommending one of the first physical routine and the second physical routine for the person based on the comparison.

The system and the method of the present disclosure aims to provide an automated, or at least a semi-automated, solution for recommending a physical routine to a person. Herein, the physical routine refers any form of physical activity performed by the person for a particular period of time. For example, swimming for one hour, running for thirty minutes or, a combination of cycling for fifteen minutes and lifting weights for fifteen minutes can be all considered as different examples of the physical routine. Furthermore, the system and the method of the present disclosure seeks to provide techniques for evaluating the effects of the physical routine on the person in order to make a decision on the recommendation of the physical routine.

The system comprises a physical sensor configured to measure an intensity of the physical routine. Herein, the physical sensor refers to a sensing arrangement which is configured to sense data related to a wide range of parameters related to some physical activity. The parameters may include distance travelled, acceleration, time spent, calories burnt, steps taken, heart rate of the user etc. The physical sensor may include one or more of sensing arrangements such as a GPS, accelerometer, pulse meter etc. In order to sense one or more of the wide range of parameters. The sensed data collected by the physical sensor is then used to measure the intensity of the physical routine. Herein, the intensity of the physical routine corresponds to the measurable effects which the physical routine is going to have on the person performing the physical routine.

Optionally, the physical sensor is installed in an electronic device associated with the person. Herein, the electronic device can be for example a smartphone or a smart watch which is associated (like physically associated, being worn) by the person. Herein, the physical sensor which is configured to measure the intensity of the physical routine, is installed on the electronic device which is associated with the person for the sake of the convenience of the person to sense the required data for enabling measurement of the intensity of the physical routine. As an alternative or additional embodiment, a physical sensor might be considered to comprise methods and arrangements to collect information, describing perceived exertion that is a measure of subjective loading that a user can give via an user interface. I.e in addition of measuring physical parameters also subjective parameters can be measured for example via user interface ("how do you feel in range of 1 to 5?" type of questionnaire.

The term "routine" in present disclosure may refer to the certain way to execute training for a certain duration and means having "set of exercises", or "a training session" or "a workout" comprising loading taking relevant time in accordance with the typical ways of performing such exercises or training. As a first example of a first routine is running each day between 11-12 AM 5 km and a second routine could be swimming saturday afternoons for a period of 30 minutes. A second example could be that a first routine is running 5 km with speed of 10 km/hour every second day and a second routine would be running 10 km with speed of 10 km/hour every other second day. A third example would be a first routine is running in general and a second routine is cycling in general.

Furthermore routine can refer to a physical session, physical loading or other physical discipline. Routine typically refers to something a person does repeatable but can in present disclosure refer to a single workout as well. Indeed one of the targets is to recommend a routine which leads to beneficial behavior for a person such as weekly or daily routine of physical activity of certain type, duration and intensity. The routine can be a training program or set of training programs. It can also be a cycle of training for specific time such as four weeks for training with a first routine followed by a training with another routine.

The system comprises a biochemical sensor configured to determine a level of a biochemical marker of the person. Herein, the biochemical sensor refers to a sensing arrangement which is configured to sense data related to a biological process involving certain chemicals, i.e., to sense data related to a biochemical. For example, a suitable sensing arrangement which is configured to measure the levels of one or more suitable hormones in a human body can be considered as an example of the biochemical sensor. The system of the present disclosure employs the biochemical sensor with the purpose of determining the level of the biochemical marker in the body of the person where the level of the biochemical undergoes changes due to performing some physical activity by the person.

Optionally, the biochemical sensor is implemented as a lateral flow strip. Herein, the lateral flow strip refers to the assay or strip which is intended to detect the presence of a target molecule in a liquid. Subsequently, the lateral flow strip is used as a medium to sense the level of the biochemical marker of the person. The biochemical sensor may also be an electrochemical sensor. The electrochemical sensor can be a sensor which is arranged to be sensitive to target molecule in a biochemical way, and to be sensed electrically. Alternatively biosensor may use spectrophotometric principles, or methods based on target molecules mass and/or electrical properties or known reactions with other molecules such as enzymes, co-enzymes or target molecule metabolites.

The system furthermore comprises a processing arrangement. Herein, the 'processing arrangement' refers to a structure and/or module that includes programmable and/or non-programmable components configured to store, process and/or share information and/or signals relating to the generating the search string. The processing arrangement may be a controller having elements, such as processors, memory, and the like. Typically, the processing arrangement is operable to perform one or more operations for processing of the sensed data from the physical sensor as well as the biochemical sensor. Optionally, the processing arrangement includes any arrangement of physical or virtual computational entities capable of enhancing information to perform various computational tasks. Further, it will be appreciated that the remote server may be implemented as a hardware server and/or plurality of hardware servers operating in a parallel or in a distributed architecture. Optionally, the processing arrangement is supplemented with additional computation system, such as neural networks, and hierarchical clusters of pseudo-analog variable state machines implementing artificial intelligence algorithms. In an example, the processing arrangement may include components such as a memory, a processor, a data communication interface, a network adapter, and the like, to store, process and/or share information with other computing devices, such as the data processing arrangement, the database arrangement, a user device.

Optionally, the processing arrangement is implemented as a computer program that provides various services (such as database service) to other devices, modules or apparatus. Moreover, the remote server refers to a computational element that is operable to respond to and processes instructions to perform the ranking of items in the list in view of the request. Optionally, the processing arrangement includes, but is not limited to, a microprocessor, a microcontroller, a complex instruction set computing (CISC) microprocessor, a reduced instruction set (RISC) microprocessor, a very long instruction word (VLIW) microprocessor, Field Programmable Gate Array (FPGA) or any other type of processing circuit, for example as aforementioned. In some examples, the processing arrangement may include components such as memory, a processor, a network adapter and the like, to store, process and/or share information with other computing components, such as a user device, a remote server unit, a database arrangement, to offload some of the processing operations and/or for providing results of the processed data to the user (e.g., the person for which the data was sensed).

Herein, in some examples, the system elements may communicate with each other using a communication interface. The communication interface includes a medium (e.g., a communication channel) through which the system components communicates with each other. Examples of the communication interface include, but are not limited to, a communication channel in a computer cluster, a Local Area Communication channel (LAN), a cellular communication channel, a wireless sensor communication channel (WSN), a cloud communication channel, a Metropolitan Area Communication channel (MAN), and/or the Internet. Optionally, the communication interface comprises one or more of a wired connection, a wireless network, cellular networks such as 2G, 3G, 4G, 5G mobile networks, and a Zigbee connection.

The processing arrangement is configured to measure, via the physical sensor, a first intensity of a first physical routine performed by the person. Herein, the first physical routine refers to a specific physical activity which is to be performed by the person according to the choice of the person itself. For example, the person may choose to swim as the first physical routine. Subsequently, while the person is performing the first physical routine, the processing arrangement uses the physical sensor to measure the first intensity of the first physical routine being performed by the user. As discussed, herein, the first intensity refers to the measurable effects of the first physical routine on the body of the person performing the first physical routine. For example, for the person swimming as the first physical routine, the first intensity can be in the form of the calories burnt by the person where the first intensity is to be measured using the physical sensor. The term "intensity" is not limited only to measuring a physical parameter (such as a parameter defined in standard units (SI units)). In some embodiments it might also include parameters that may contribute to the impact of a routine. Such parameters include training companions (a pet or a friend), air quality, time spent indoors/outdoors, beauty of the environment, nutritional status, and so on. Optionally, these parameters can be used as determinants of a routine (i.e. biking indoors vs. outdoors, jogging alone vs. jogging with a dog, morning swimming without breakfast or with a breakfast, and so on). Technically such parameters can be collected using for example context aware sensors (cameras as an example) or using user input via an user interface.

Optionally, the processing arrangement is configured to record a first time duration of the first physical routine, as performed by the person. Herein, the first time duration of the first physical routine refers to the time period for which the first physical routine is being performed by the person. For example, the processing arrangement may record the person swimming for one hour as the first time duration of the first physical routine.

The processing arrangement is then configured to determine a first training impulse value corresponding to the first physical routine as performed by the person based, at least in part, on the measured first intensity thereof. Herein, the training impulse refers to a means of quantifying training load and stress which is imparted on the person performing some physical activity. Subsequently, the first training impulse refers to the training load which is imparted on the person by performing the first physical routine.

Optionally, the processing arrangement is configured to calculate the first training impulse value based on the measured first intensity and the recorded first time duration. Herein, the first training impulse is determined using a formula where the measured first intensity is multiplied with the time duration for which the first physical routine is performed. For example, if the first intensity is measured to be 100 units and the recorded first time duration is of 30 minutes, then the first training impulse is determined to be 3000 units. In an example, the first training impulse value is calculated based on the heart rate of the person. For instance, the first training impulse value (First TRIMP) is calculated as 'ΣHRR', where:

$$HRR=(\text{Training HR}-\text{Resting HR})/(\text{Max HR}-\text{Resting HR});$$

wherein, 'Training HR' is heart rate measured during the physical routine, 'Resting HR' is the resting heart rate of the person (i.e., before performing the first physical routine); and 'Max HR' is the maximum heart rate of the person (which can be estimated for example using formula of 206−0.7×age, or determined while performing the first physical routine or any other prior physical routine).

In one example, TRIMP=time (mins)×HRR×y, Where; time=duration (mins), HRR=fractional elevation in HR or HR reserve as described above, and y=weighting factor. The weighting factor y increases with increasing HRR with a more steady rise when HR approaches Max HR. There are models that define y for example based on gender (providing different equations for men and women).

As a further example of calculating a training impulse value is using measured accelerations during the training and known weight of the person. Yet another example is using distance and elevation distance during the training. For example if during a skiing elevation change of 100 meters took place this can be used to determine training impulse by calculating for example change in potential energy in respect to duration of time of climb (in essence power).

Optionally, the first training impulse is determined at a first moment of time and the second training impulse is determined at a second moment of time, and wherein the second moment of time is at least 12 hours apart from the first moment of time but within at least 120 hours from the first moment of time. Herein, the first moment of the time refers to the instance of time at which the first training impulse is determined after the completion of the first physical routine. Herein, the second moment of the time refers to the instance of time at which the second training impulse is determined after the completion of the second physical routine. Subsequently, it is to be noted that the time period between the first moment of time and second moment of time, i.e., between determining the first training impulse and determining the second training impulse should not be less than 12 hours and should not exceed 120 hours. As an example a time period between the first moment of time and second moment of time should be between 12, 14, 16, 18, 20, 22, 24, 48, 50, 60, 70, 80, 90, 100 hours and to 14, 16, 18, 20, 22, 24, 48, 50, 60, 70, 80, 90, 100, 110, 120 hours.

As an example, if the second physical routine is performed shortly after the first physical routine, such as within 12 hours, it is probable that the person who performed the routine has not fully recovered from the first physical routine and the results of the second physical routine can be affected by the first routine. Additionally, it is preferable to have a nightly sleep between the routines to stabilize the biomarker levels after the first routine. On the other hand, if the time interval between the routines is very long, such as longer than 120 hours, biomarker baseline levels may have been changed by other factors so that the comparison between the routines is no longer valid.

Optionally the method of the present disclosure, wherein each of the first time duration and the second time duration is at least 10 minutes. In essence, each of the first physical routine and the second physical routine are to be performed for at least a minimum of 10 minutes. Optionally, both the first and second physical routines are performed for a maximum of 150 minutes. The benefit of this arrangement is that the expected biochemical response to the physical routine is big enough to be reliably detected (after about 10 minutes) and the biochemical response can be expected to increase up to about 120-150 minutes of duration of most physical routines. As an further example the first or the second duration of time is between 10, 20, 30, 40, 50, 60, 70, 80, 90, 100, 110, 120 minutes and 20, 30, 40, 50, 60, 70, 80, 90, 100, 110, 120, 130, 140 150 minutes.

The processing arrangement is further configured to determine, via the biochemical sensor, a first level of a biochemical marker of the person associated with completion of the first physical routine, as performed by the person. Herein, the first biochemical marker refers to the change in levels of the biochemical in the body of the person after the completion of the first physical routine by the person. Herein, the changes in the levels of the biochemical in the person occurs as a result of the performance of the first physical routine by the person.

In the present implementation, the processing arrangement may be further configured to record, via the biochemical sensor, a first baseline level of the biochemical marker of the person, the first baseline level being recorded prior to starting of the first physical routine by the person. Herein, the first baseline level of the biochemical marker refers to the level of the biochemical in the person's body, recorded before the person performs the first physical routine. For example, the person may use the biochemical sensor before performing the first physical routine to record the first baseline level of biochemical marker to be 10 units.

In the present implementation, the processing arrangement can configured to record, via the biochemical sensor, a first closing level of the biochemical marker of the person within a predefined time interval after completion of the first physical routine, as performed by the person. Herein, the first closing level of the biochemical markers refers to the level of the biochemical in the person's body, recorded after the completion of the first physical routine by the person. Herein, the predefined interval of time refers to the time period after the completion of the first physical routine at which the first closing level of the biochemical marker is recorded. The predefined interval of time may be chosen according to the preferences of the person. For example, the person may use the biochemical sensor 10 minutes after performing the first physical routine to record the first closing level of biochemical marker to be 30 units.

Optionally, the predefined time interval is in a range of 1 minute to 30 minutes. In an example, the predefined time interval may be 1 minute, 2 minutes, 3 minutes, 4 minutes, 5 minutes, 6 minutes, 7 minutes, 8 minutes, 9 minutes, 10 minutes, 11 minutes, 12 minutes, 13 minutes, 14 minutes, 15 minutes, 16 minutes, 17 minutes, 18 minutes, 19 minutes, 20 minutes, 21 minutes, 22 minutes, 23 minutes, 24 minutes, 25 minutes, 26 minutes, 27 minutes, 28 minutes, 29 minutes up to 2 minutes, 3 minutes, 4 minutes, 5 minutes, 6 minutes, 7 minutes, 8 minutes, 9 minutes, 10 minutes, 11 minutes, 12 minutes, 13 minutes, 14 minutes, 15 minutes, 16 minutes, 17 minutes, 18 minutes, 19 minutes, 20 minutes, 21 minutes, 22 minutes, 23 minutes, 24 minutes, 25 minutes, 26 minutes, 27 minutes, 28 minutes, 29 minutes, 30 minutes.

Optionally, the processing arrangement is further configured to calculate the first level of the biochemical marker based on the recorded first closing level of the biochemical marker and the recorded first baseline level of the biochemical marker. Herein, the first level of the biochemical marker corresponds to the difference of the first closing level of the biochemical marker and the first baseline level of the biochemical marker. For example, if the first closing level is recorded to be 30 units and the first baseline level is recorded to be 10 units, then the first level of the baseline marker is calculated to be 20 units.

Optionally, the first level of biochemical marker includes one of: a first level of testosterone, a first level of cortisol, a first ratio of the first level of testosterone to the first level of cortisol. That is, the first biochemical marker may correspond to either one of the first level of cortisol or the first level of testosterone, or the first ratio of the first level of testosterone to the first level of cortisol. Herein, the first level of testosterone refers to the certain level of testosterone present in the person's body at the time of being determined via the biochemical sensor, where testosterone refers to a hormone present in the human body. Herein, the first level of cortisol refers to the certain level of cortisol present in the person's body at the time of being determined via the biochemical sensor, where cortisol refers to a hormone present in the human body. In a preferred example, the first ratio of the first level of testosterone to the first level of cortisol is utilized which is obtained by dividing the first level of testosterone to the first level of cortisol.

The processing arrangement is further configured to calculate a first response value for the first physical routine based on the determined first training impulse value and the determined first level of the biochemical marker. Herein, the first response value refers to a means of quantifying the change of the biochemical levels occurring in the person's body in association with the first training impulse corresponding to the first physical routine. Indeed this step of using the first (second etc.) training impulse value and respective determined first (second etc.) level of biochemical marker has been found a surprisingly good way to form a first (second etc.) response value. Indeed in tests carried out with target persons it has been observed that usage of only training impulse or biochemical values is not sufficient to provide recommendations. Combination of the training impulse and related biochemical level is found to be working combination.

Optionally, the processing arrangement is configured to calculate the first response value based on a ratio of the determined first level of the biochemical marker and the determined first training impulse value. Herein, the first response value is calculated by the dividing the value of the first training impulse by the first level of the biochemical marker, where the resultant ratio corresponds to the first response value. For example, if the first training impulse is determined to be 2000 units and the first level of biochemical marker is determined to be 20 units, then the first response level is calculated to be 100 units.

The processing arrangement is then configured to measure, via the physical sensor, a second intensity of a second physical routine performed by the person. Herein, the second physical routine refers to a specific physical activity which is to be performed by the person according to the choice of the person itself, where the second physical routine can be any physical activity except the first physical routine. For example, the person may choose to run as the second physical routine. Subsequently, while the person is performing the second physical routine, the processing arrangement uses the physical sensor to measure the second intensity of the second physical routine being performed by the user. As discussed, herein, the second intensity refers to the measurable effects of the second physical routine on the body of the person performing the second physical routine. For example, for the person running as the second physical routine, the second intensity can be in the form of the calories burnt by the person where the second intensity is to be measured using the physical sensor.

Optionally, the processing arrangement is configured to record a second time duration of the second physical routine, as performed by the person. Herein, the second time duration of the second physical routine refers to the time period for which the second physical routine is being performed by the person. For example, the processing arrangement may record the person running for thirty minutes as the first time duration of the first physical routine.

The processing arrangement is then configured to determine a second training impulse value corresponding to the second physical routine as performed by the person based, at least in part, on the measured second intensity thereof. Herein, the second training impulse refers to the training load which is imparted on the person by performing the second physical routine.

Optionally, the processing arrangement is configured to calculate the second training impulse value based on the measured second intensity and the recorded second time duration. Herein, the second training impulse is determined using a formula where the measured second intensity is multiplied with the time duration for which the second physical routine is performed. For example, if the second intensity is measured to be 200 units and the recorded second time duration is of 45 minutes, then the second training impulse is determined to be 9000 units. In an example, the second training impulse value is calculated based on heart rate of the person. For instance, the second training impulse value (Second TRIMP) is calculated as 'ΣHRR', where:

HRR=(Training HR−Resting HR)/(Max HR−Resting HR);

wherein, 'Training HR' is heart rate measured during the physical routine, 'Resting HR' is the resting heart rate of the person (i.e., before performing the second physical routine); and 'Max HR' is the maximum heart rate of the person (estimated by 206−0.7×age, or determined while performing the first physical routine or any other prior physical routine).

Optionally the second training impulse and the first training impulse can be calculated using different or same formulas. Different formulas are beneficial if the first routine is significantly different from the second routine. As an example if the first routine is weight lifting (amount of weights during training is used for the impact) and the second routine is running (number of steps and distance and speed).

The processing arrangement is further configured to determine, via the biochemical sensor, a second level of a biochemical marker of the person associated with completion of the second physical routine, as performed by the person. Herein, the second biochemical marker refers to the changed levels of the biochemical in the body of the person after the completion of the second physical routine by the person. Herein, the changes in the levels of the biochemical in the person occurs as a result of the performance of the second physical routine by the person.

In the present implementation, the processing arrangement is further configured to record, via the biochemical sensor, a second baseline level of the biochemical marker of the person, the second baseline level being recorded prior to starting of the second physical routine by the person. Herein, the second baseline level of the biochemical marker refers to the level of the biochemical in the person's body, recorded before the person performs the second physical routine. For example, the person may use the biochemical sensor before performing the second physical routine to record the second baseline level of biochemical marker to be 15 units.

In the present implementation, the processing arrangement is configured to record, via the biochemical sensor, a second closing level of the biochemical marker of the person within a predefined time interval after completion of the second physical routine, as performed by the person. Herein, the second closing level of the biochemical markers refers to the level of the biochemical in the person's body, recorded after the completion of the second physical routine by the person. Herein, the predefined interval of time refers to the time period after the completion of the second physical routine at which the second closing level of the biochemical marker is recorded. The predefined interval of time may be chosen according to the preferences of the person. For example, the person may use the biochemical sensor 15 minutes after performing the second physical routine to record the second closing level of the biochemical marker to be 25 units.

Optionally, the processing arrangement is further configured to calculate the second level of the biochemical marker based on the recorded second closing level of the biochemical marker and the recorded second baseline level of the biochemical marker. Herein, the second level of the biochemical marker corresponds to the difference of the second closing level of the biochemical marker and the second baseline level of the biochemical marker. For example, if the second closing level is recorded to be 25 units and the second baseline level is recorded to be 15 units, then the second level of the baseline marker is calculated to be 10 units.

Optionally, the second level of biochemical marker includes one of: a second level of testosterone, a second level of cortisol, a second ratio of the second level of testosterone to the second level of cortisol. That is, the second biochemical marker corresponds to either one of the second level of cortisol or the second level of testosterone, or the second ratio of the second level of testosterone to the second level of cortisol. Herein, the second level of testosterone refers to the certain level of testosterone present in the person's body at the time of being determined via the biochemical sensor, where testosterone refers to a hormone present in the human body. Herein, the second level of cortisol refers to the certain level of cortisol present in the person's body at the time of being determined via the biochemical sensor, where cortisol refers to a hormone present in the human body. In a preferred example, the second ratio of the second level of testosterone to the second level of cortisol is utilized which is obtained by dividing the first level of testosterone to the first level of cortisol.

The processing arrangement is further configured to calculate a second response value for the second physical routine based on the determined second training impulse value and the determined second level of the biochemical marker. Herein, the second response value refers to a means of quantifying the change of the biochemical levels occurring in the person's body in association with the second training impulse corresponding to the second physical routine.

Optionally, the processing arrangement is configured to calculate the second response value based on a ratio of the determined second level of the biochemical marker and the determined second training impulse value. Herein, the second response value is calculated by the dividing the value of the second training impulse by the second level of the biochemical marker, where the resultant ratio corresponds to the second response value. For example, if the second training impulse is determined to be 2500 units and the second level of biochemical marker is determined to be 10 units, then the second response level is calculated to be 250 units.

The processing arrangement is further configured to compare the calculated first response value and the calculated second response value. That is, both the first response value and the second response value, which have been calculated by the processing arrangement, are then compared in order to determine the value which is higher or lower from the first response value and the second response value, according to preference of the person. Herein, in some examples, the value to be selected, or the said preference, may be based on the intention of choosing between the first physical routine and the second physical routine. That is, if the person may be choosing between the two for identifying more strenuous physical routine therefor, then the higher of the two values may be selected based on the comparison; and vice-versa. It has been found out that provided method enables to provide recommendations for various of routines, also when a first routine and a second routine are not related from sport type point of view.

The processing arrangement is then configured to recommend one of the first physical routine and the second physical routine for the person based on the comparison. Herein, the person the processing arrangement recommends the physical routine having higher or lower response value according to the requirements of the person, where the first response value of the first physical routine has already been previously compared with the second response value of the second physical routine. For example, the person performing both the first physical routine and second physical routine may opt to use the processing arrangement to recommend the physical routine having higher response value out of the two physical routines performed by the user, as discussed above.

Moreover, the present disclosure also relates to the method as described above. Various embodiments and variants disclosed above apply mutatis mutandis to the method.

Herein, a method for recommending a physical routine to a person is described. The method comprises determining a first training impulse value corresponding to a first physical routine performed by the person. The method further comprises determining a first level of a biochemical marker of the person associated with completion of the first physical routine, as performed by the person. The method further comprises calculating a first response value for the first physical routine based on the determined first training impulse value and the determined first level of the biochemical marker. The method further comprises determining a second training impulse value corresponding to a second physical routine performed by the person. The method further comprises determining a second level of the biochemical marker of the person associated with completion of the second physical routine, as performed by the person. The method further comprises calculating a second response value for the second physical routine based on the determined second training impulse value and the determined second level of the biochemical marker. The method further comprises comparing the calculated first response value and the calculated second response value. The method further comprises recommending one of the first physical routine and the second physical routine for the person based on the comparison.

Optionally, determining the first level of the biochemical marker of the person comprises recording a first baseline level of the biochemical marker of the person, the first baseline level being recorded prior to starting of the first physical routine by the person; recording a first closing level of the biochemical marker of the person within a predefined time interval after completion of the first physical routine, as performed by the person; and calculating the first level of the biochemical marker based on the recorded first closing level of the biochemical marker and the recorded first baseline level of the biochemical marker. Further, determining the second level of the biochemical marker of the person comprises recording a second baseline level of the biochemical marker of the person, the second baseline level being recorded prior to starting of the second physical routine by the person; recording a second closing level of the biochemical marker of the person within a predefined time interval after completion of the second physical routine, as performed by the person; and calculating the second level of the biochemical marker based on the recorded second closing level of the biochemical marker and the recorded second baseline level of the biochemical marker.

Optionally, the predefined time interval is in a range of 1 minute to 30 minutes.

Optionally, the first level of biochemical marker includes one of: a first level of testosterone, a first level of cortisol, a first ratio of the first level of testosterone to the first level of cortisol, and wherein the second level of biochemical marker includes one of: a second level of testosterone, a second level of cortisol, a second ratio of the second level of testosterone to the second level of cortisol.

Optionally, determining the first training impulse value comprises measuring a first intensity of the first physical routine, as performed by the person; recording a first time duration of the first physical routine, as performed by the person; and calculating the first training impulse value based on the measured first intensity and the recorded first time duration. Further, determining the second training impulse value comprises measuring a second intensity of the second physical routine, as performed by the person recording a second time duration of the second physical routine, as performed by the person; and calculating the second training impulse value based on the measured second intensity and the recorded second time duration.

Optionally, calculating the first response value comprises calculating a ratio of the determined first level of the biochemical marker and the determined first training impulse value; and calculating the second response value comprises calculating a ratio of the determined second level of the biochemical marker and the determined second training impulse value.

Optionally, the first training impulse is determined at a first moment of time and the second training impulse is determined at a second moment of time, and wherein the second moment of time is at least 12 hours apart from the first moment of time but within at least 120 hours from the first moment of time.

Optionally the method of the present disclosure, wherein each of the first time duration and the second time duration is at least 10 minutes.

Experiment 1

A three person study was conducted. First person had been determined by an expert to be most suitable for swimming, the second person had been determined to be most suitable for cycling and the third for running prior to conducting the study. Purpose of the study was to find out which physical routine suits best for each person using a method according to the present disclosure and is there correlation between expert recommendation and the recommendation based on the method.

Each person conducted three different physical routines namely swimming, running and cycling for certain time periods of certain intensity. The physical routines were conducted on different days and had 24 hours between the routines. Time period and intensity values were used to determine a first, a second and a third training impulses for respective conducted sport routines.

Testosterone (T) and cortisol (C) levels were measured after each conducted sports routine (training). This first, second or third biochemical marker of T/C (testosterone (pmol/l) divided by cortisol (nmol/l)) level (value) was divided by the respective training impulse values to calculate a first, a second and a third respective response value. Table I provides determined biochemical marker levels as well as a duration and intensity values associated with each of the sports. Table II provides calculated training impulse values (TRIMP) as well as calculated response values. TRIMP was calculated using equation:

$$TRIMP=time \times Z \times 0.64 \exp(1.92 \times Z), \text{ wherein}$$

$$Z=(HB-HR_rest)/(HR_max-HR_rest)$$

HR_rest for first, second and third persons was 60, 55 and 40 beats per minute respectively. HR_max for first, second and third persons was 190, 195, 200 respectively. HB is "intensity" i.e. heart beats per minute.

TABLE I

Determined biochemical marker levels and duration (time in minutes) and intensity (heart beats per minute) values for each person for each sports activity in the experiment.

| Person | Sport | Testo (pmol/l) | Cortisol (nmol/l) | T/C | Time | Intensity |
|---|---|---|---|---|---|---|
| 1 | Running | 315 | 7 | 45.0 | 30 | 165 |
| 1 | Swimming | 280 | 11 | 25.5 | 35 | 135 |
| 1 | Cycling | 342 | 9 | 38.0 | 90 | 140 |
| 2 | Running | 234 | 7 | 33.4 | 60 | 145 |
| 2 | Swimming | 150 | 21 | 7.1 | 30 | 155 |
| 2 | Cycling | 431 | 6 | 71.8 | 60 | 135 |
| 3 | Running | 507 | 16 | 31.7 | 20 | 155 |
| 3 | Swimming | 401 | 9 | 44.6 | 40 | 145 |
| 3 | Cycling | 616 | 27 | 22.8 | 45 | 160 |

TABLE II calculated training impulse values (TRIPM) derived from duration of time and intensity (beats per minute) and calculated response values.

| Person | Sport | TRIMP | Response value |
|---|---|---|---|
| 1 | Running | 73 | 0.6154 |
| 1 | Swimming | 39 | 0.6506 |
| 1 | Cycling | 116 | 0.3289 |
| 2 | Running | 85 | 0.3941 |
| 2 | Swimming | 54 | 0.1322 |
| 2 | Cycling | 66 | 1.0928 |
| 3 | Running | 37 | 0.8665 |
| 3 | Swimming | 59 | 0.7523 |
| 3 | Cycling | 91 | 0.2503 |

Based on the experimental results it was observed that the method provides a surprising way to recommend a physical routine for a person. In this experiment swimming for person 1, cycling for person 2 and running for person 3. This is in line with assessment of the expert for each of the persons. For each of the persons the calculated response value correlated with assessment, made by the expert, of the most suitable routine for said persons.

Experiment 2

In a second experiment we compared 4 persons, who participated in two routines: a first routine was a training program that lasted 2 weeks, and a second routine was a control program that also lasted 2 weeks. In this experiment, the subjects also had a two week wash-out period to avoid potential cross-over effects from the first program.

Determined biochemical marker was blood cholesterol (LDL which should be lowered in a favorable situation). The biochemical marker was determined by measuring cholesterol values from blood samples in a laboratory.

TABLE III

Biochemical markers of the experiment 2 (LDL cholesterol mmol/l).

| Subject | Baseline1 mmol/l | Physical Routine 1 mmol/l | Physical Routine 2 mmol/l |
|---|---|---|---|
| 1 | 3 | 2.7 | 3 |
| 2 | 3.7 | 3.9 | 3.8 |
| 3 | 3.5 | 3.1 | 3.5 |
| 4 | 2.8 | 2.5 | 2.9 |

Training intensity was determined by daily steps. The training program (the first routine) consisted of keeping daily steps above 8000 steps/day on 5 out of 7 days weekly. The added steps/day was used to determine if there was a first training impulse or not for each participant of the test. Because inactive lifestyle corresponds to 5000 steps/day, the period exceeded the inactive lifestyle level by (8000−5000) steps/day=+3000 steps/day, and the first routine was determined to constitute a training impulse (+3000 steps/day clearly exceeds sedentary level, and therefore response.class=1). In fact, the training impulse could be classified into more classes, but since this experiment only included two kinds of routines, other potential training classes were not considered at this time.

The control program (the second routine) consisted of keeping daily steps below 5000 steps/day at least 5 out of 7 days and as an additional criterion avoiding any physical routines that would exceed the intensity of walking. Correspondingly, the second program did not exceed the sedentary level (5000 steps/day) and subsequently, did not constitute a training impulse (class=0).

As explained in detail above, based on the first training impulse we classified the first routine as training and the second routine as non-training for all subjects (See Table IV). As illustrated in Table IV, the first response value was determined as response amount=(−0.3, 0.2, −0.4, and −0.3) mmol/l and response.class=(1, 1, 1, 1) for the subjects. Accordingly, the first response.amount was favorable (negative) for subjects 1, 3, and 4, and the first routine was determined to represent class training for all of them. The second response value was response. amount=(+0.0, +0.1, +0.0, and +0.1) mmol/l and response.class=(0, 0, 0, 0) for the subjects. In other words, the second response.amount was non-existing or even unfavorable in every subject, and the response. class was determined to represent non-training.

TABLE IV

The first and the second response values of the experiment 2.

| The first response value | | The second response value | |
|---|---|---|---|
| response.amount | response.class (*) | response.amount | response.class (*) |
| −0.3 | 1 | 0 | 0 |
| 0.2 | 1 | 0.1 | 0 |
| −0.4 | 1 | 0 | 0 |
| −0.3 | 1 | 0.1 | 0 |

(*) 1 = training. 0 = non-training

Based on the results, the response.amount for response.class=1 (i.e. training response, the first routine for all) was more favorable than the corresponding amount for response.class=0 (i.e. non-training response, the second routine for all) for subjects 1, 3 and 4, and the system was able to recommend the step-based training program (keeping daily steps above 8000 steps/day) for these three subjects. However, this recommendation was not made for subject 2.

Experiment 3

Following the principles of Experiment 1, we conducted another experiment in order to observe the personal suitability of changing training principles within the given sports discipline. In this case, we compared two female runners, both on national olympic level. Both of them had active training and top-level competitions during protocol. Both of them were long distance runners, but have different emphasis on their talent and suitable training program composition. Another of them made a national record in long distance competition, another of them scored second in World championship competition—also in long distance run—during our experiment protocol.

In the comparison, we wanted to see if different intensities are suitable for genetically different athletes compared by the anabolic index (as testosterone to cortisol ratio, or T/C) in the evening. In analysis, exercises that were either steady state running or interval training but performed on the average same training volume (60+/−5 min; 155-165 HR avg) were collected into analysis.

According to analysis (see Table V), athletes reacted differently to steady state and HIIT/Interval running exercises by the anabolic index (T/C) in the evening. This information is highly valuable in optimizing training program and exercise modality as a part of coaching.

TABLE V

Biochemical marker (Anabolic index as T/C) after first (Interval type) exercise load and second (steady state type) exercise load.

| | Anabolic Index (T/C) | Anabolic Index (T/C) |
|---|---|---|
| SUBJECT 1. | Interval | Steady state |
| Average | 185.55 | 121.9 |
| STD | 58.9 | 48.0 |
| Subject 2. | Interval | Steady state |
| Average | 44.9 | 86.5 |
| STD | 12.9 | 36.2 |

DETAILED DESCRIPTION OF DRAWINGS

Referring to FIG. 1, there is shown a block diagram of a system 100 for recommending a physical routine to a person, in accordance with an embodiment of the present disclosure. Herein, the system 100 comprises a processing arrangement 102. Further, the system 100 comprises a physical sensor 104 sharing data with the processing arrangement 102. Furthermore, the system 100 comprises a biochemical sensor 106 sharing data with the processing arrangement 102.

Figure 2:
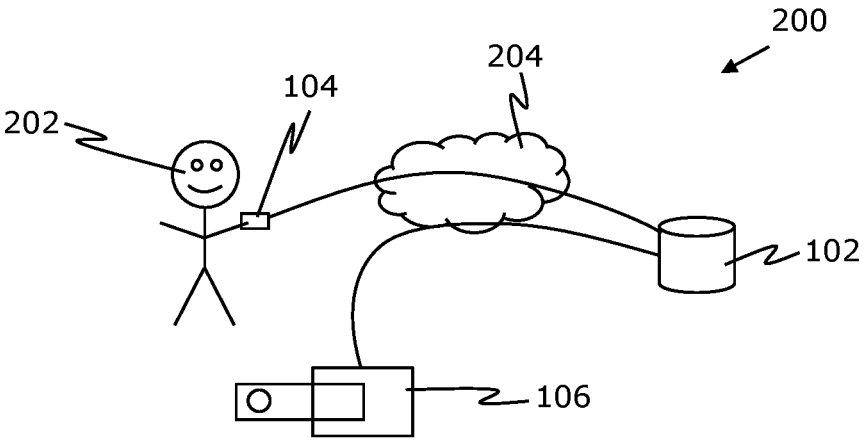
FIG. 2 is a visual representation of the person using a physical sensor and a biochemical sensor for implementation of the system of FIG. 1, in accordance with the implementation of the present disclosure.

Referring to FIG. 2, there is a visual representation 200 of the person using the physical sensor and the biochemical sensor for implementation of the system 100, in accordance with the implementation of the present disclosure. Herein, the person 202 is using the physical sensor 104 to record the intensity of the training routine, which sends the recorded data to the processing arrangement 102 via a communication network 204. Furthermore, the person 202 is using the biochemical sensor 106 to record the level of the biochemical marker, which also sends the recorded data to the processing arrangement 102 via the communication network 204. The processing arrangement 102 will form the recommendation and provide that to the person.

Figure 3:
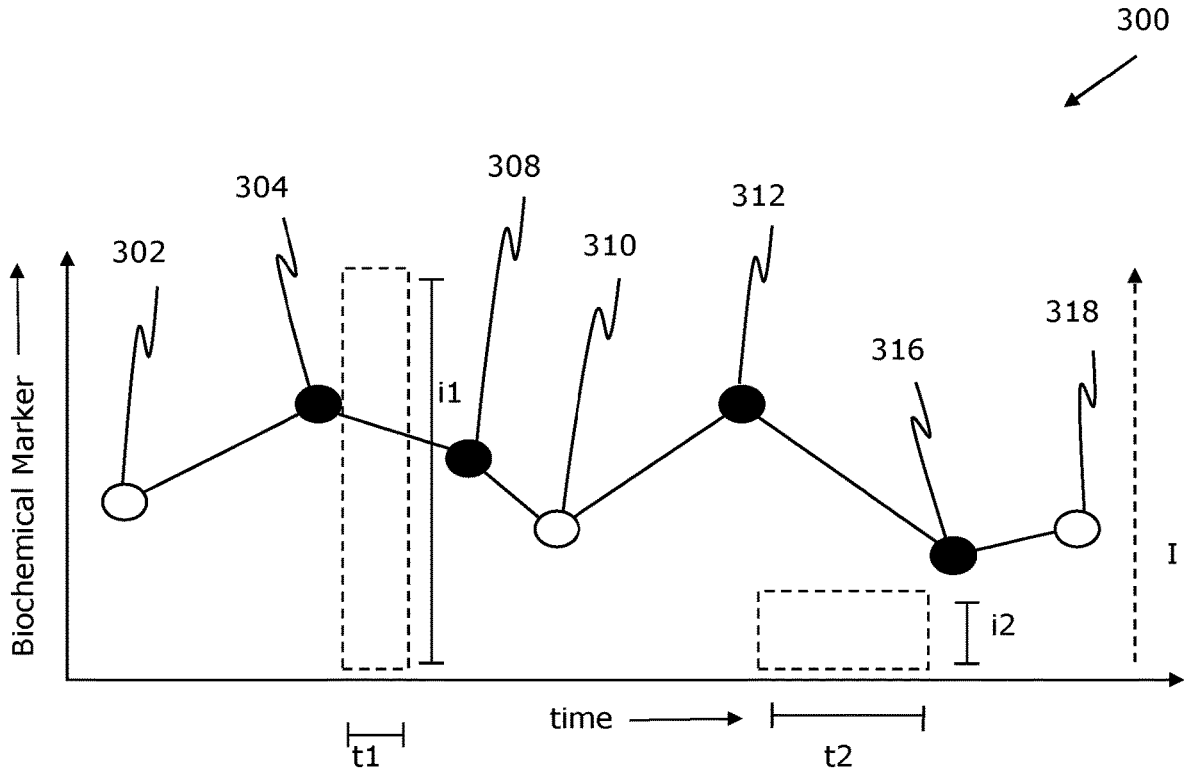
FIG. 3 is an exemplary graphical representation of measurements of different levels of the biochemical marker, as utilized for recommending a physical routine to a person, in accordance with the implementation of the present disclosure.

Referring to FIG. 3, there is shown an exemplary graphical representation 300 of measurements of different levels of the biochemical marker, as utilized for recommending a physical routine to the person (such as, the person 202), in accordance with the implementation of the present disclosure. Herein, the horizontal axis represents the instances of time, and the vertical axis represents the level of the biochemical marker (and correspondingly also intensity of the physical routine). As shown, the first baseline level 304 is recorded prior to the first time duration t1, and the first closing level 308 is recorded after the first time duration t1. Further, the corresponding first intensity i1 is determined. Similarly, the second baseline level 312 is recorded prior to the second time duration t2, and the second closing level 316 is recorded after the second time duration t2. Further, the corresponding second intensity i2 is determined.

Figure 4A:
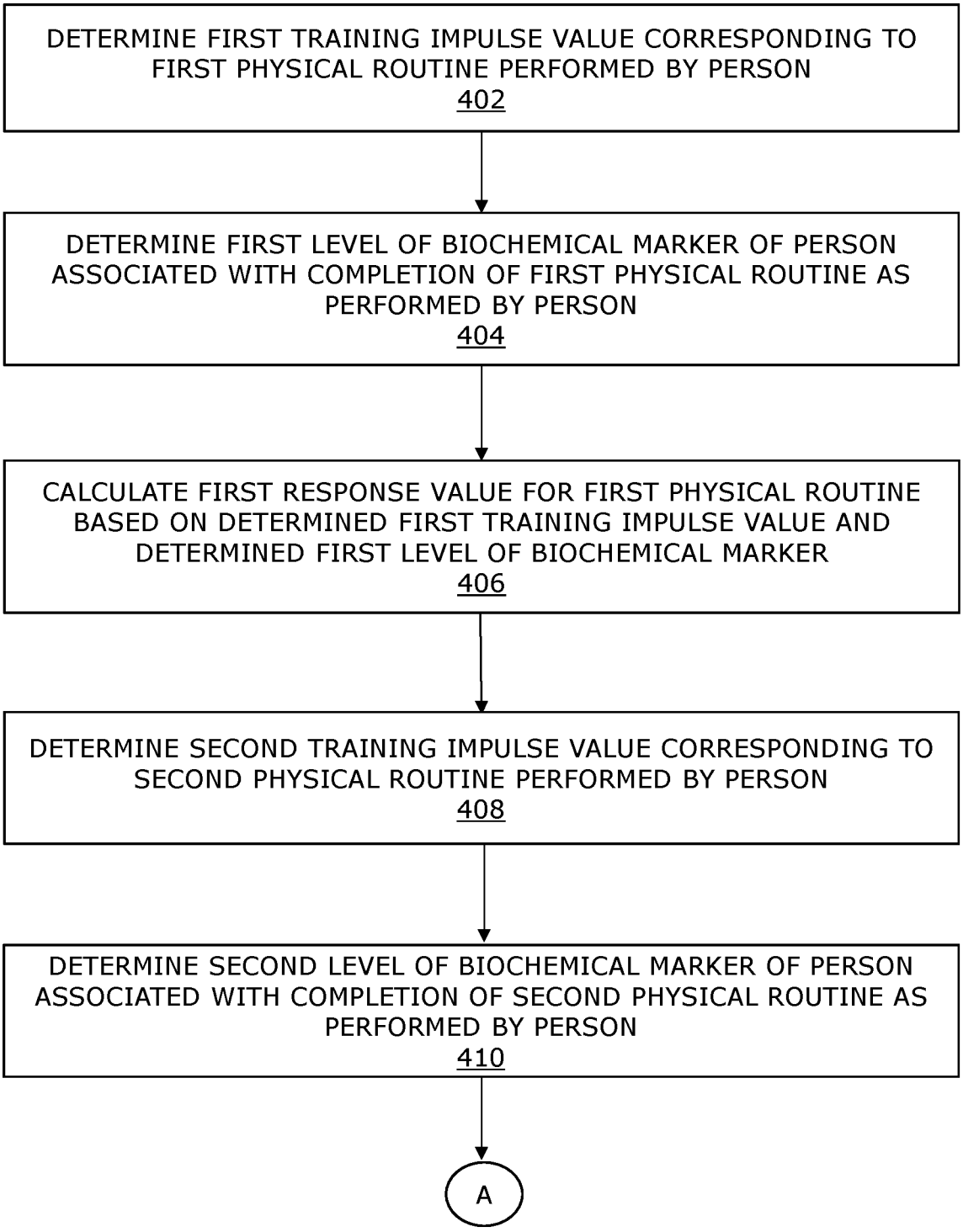
FIGS. 4A and 4B collectively illustrates a flowchart listing steps of a method for recommending a physical routine to a person, in accordance with another embodiment of the present disclosure.
Figure 4B:
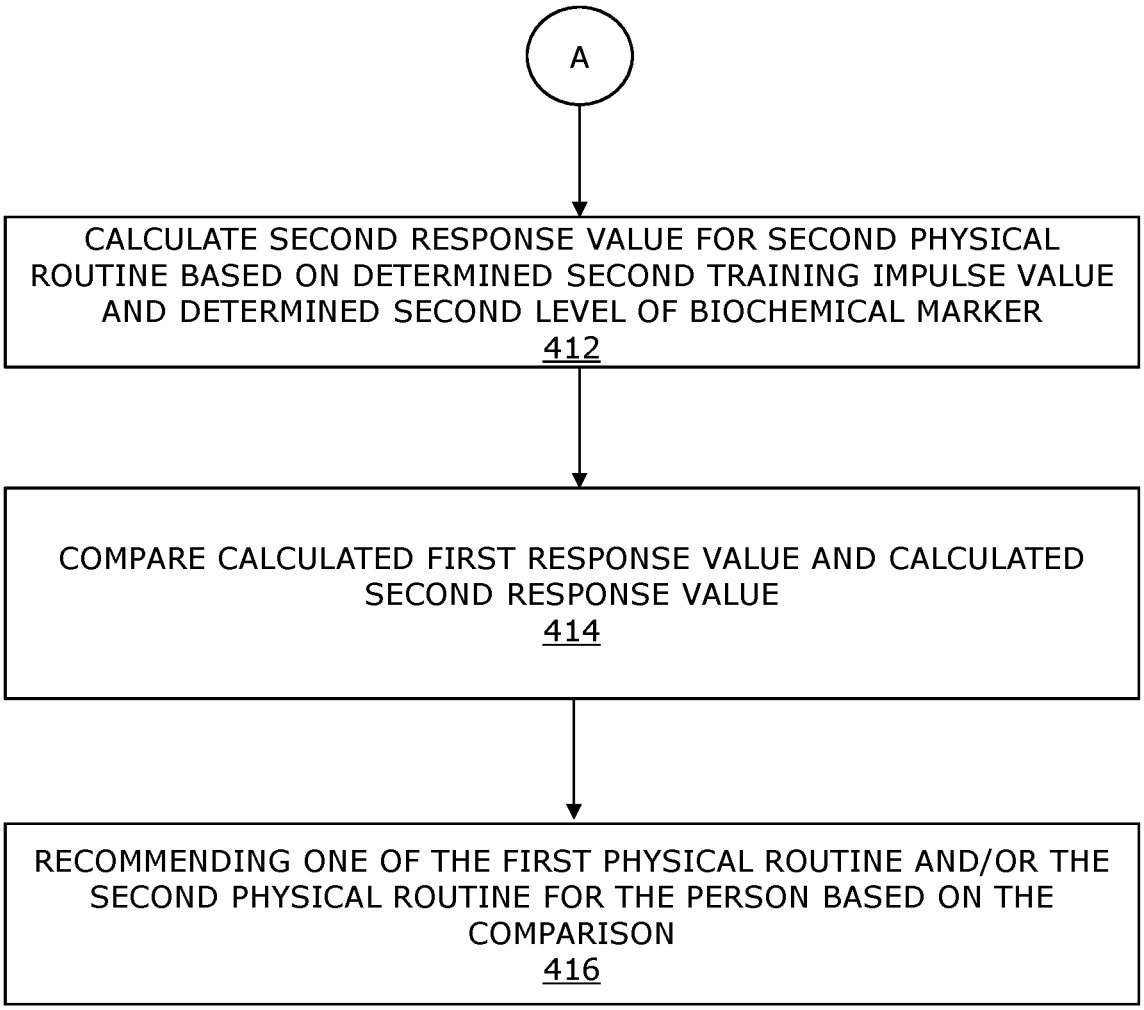

Referring to FIGS. 4A and 4B collectively, there is shown a flowchart depicting steps of a method for recommending a physical routine to a person, in accordance with another embodiment of the present disclosure. At step 402, a first training impulse value corresponding to a first training routine performed by the person is determined. At step 404, a first level of the biochemical marker of the person associated with completion of the first physical routine, as performed by the person is determined. At step 406, a first response value for the first physical routine based on the determined first training impulse value and the determined first level of the biochemical marker is calculated. At step 408, a second training impulse value corresponding to a second physical routine performed by the person is determined. At step 410, a second level of the biochemical marker of the person associated with completion of the second physical routine, as performed by the person is determined.

At step 412, a second response value for the second physical routine based on the determined second training impulse value and the determined second level of the biochemical marker is calculated. At step 414, the calculated first response value and the calculated second response value is compared. At step 416, one of the first physical routine and the second physical routine for the person based on the comparison is recommended.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural. The word "exemplary" is used herein to mean "serving as an example, instance or illustration". Any embodiment described as "exemplary" is not necessarily to be construed as preferred or advantageous over other embodiments and/or to exclude the incorporation of features from other embodiments. The word "optionally" is used herein to mean "is provided in some embodiments and not provided in other embodiments". It is appreciated that certain features of the present disclosure, which are, for clarity, described in the context of separate embodiments, may also be provided in combination in a single embodiment. Conversely, various features of the present disclosure, which are, for brevity, described in the context of a single embodiment, may also be provided separately or in any suitable combination or as suitable in any other described embodiment of the disclosure.

The invention claimed is:

1. A method for recommending a physical routine to a person, comprising:

determining a first training impulse value corresponding to a first physical routine performed by the person;

determining a first level of a biochemical marker of the person associated with completion of the first physical routine, as performed by the person, wherein the first level of a biochemical marker includes a first ratio of a first level of testosterone to a first level of cortisol;

calculating a first response value for the first physical routine based on the determined first training impulse value and the determined first level of the biochemical marker, wherein calculating the first response value is based on a ratio of the determined first level of the biochemical marker and the determined first training impulse value;

determining a second training impulse value corresponding to a second physical routine performed by the person;

determining a second level of the biochemical marker of the person associated with completion of the second physical routine, as performed by the person, wherein the second level of a biochemical marker includes a second ratio of a second level of testosterone to a second level of cortisol;

calculating a second response value for the second physical routine based on the determined second training impulse value and the determined second level of the biochemical marker, wherein calculating the second response value is based on a ratio of the determined second level of the biochemical marker and the determined second training impulse value;

comparing the calculated first response value and the calculated second response value; and recommending one of the first physical routine and the second physical routine for the person based on the comparison.

2. A method according to claim 1, wherein:

determining the first level of the biochemical marker of the person comprises:

recording a first baseline level of the biochemical marker of the person, the first baseline level being recorded prior to starting of the first physical routine by the person;

recording a first closing level of the biochemical marker of the person within a predefined time interval after completion of the first physical routine, as performed by the person; and calculating the first level of the biochemical marker based on the recorded first closing level of the biochemical marker and the recorded first baseline level of the biochemical marker, and determining the second level of the biochemical marker of the person comprises:

recording a second baseline level of the biochemical marker of the person, the second baseline level being recorded prior to starting of the second physical routine by the person;

recording a second closing level of the biochemical marker of the person within a predefined time interval after completion of the second physical routine, as performed by the person; and calculating the second level of the biochemical marker based on the recorded second closing level of the biochemical marker and the recorded second baseline level of the biochemical marker.

3. A method according to claim 2, wherein the predefined time interval is in a range of 1 minute to 30 minutes.

4. A method according to claim 1, wherein the first level of biochemical marker includes one of: a first level of testosterone, a first level of cortisol, a first ratio of the first level of testosterone to the first level of cortisol, and wherein the second level of biochemical marker includes one of: a second level of testosterone, a second level of cortisol, a second ratio of the second level of testosterone to the second level of cortisol.

5. A method according to claim 1, wherein:

determining the first training impulse value comprises:

measuring a first intensity of the first physical routine, as performed by the person;

recording a first time duration of the first physical routine, as performed by the person; and calculating the first training impulse value based on the measured first intensity and the recorded first time duration, and determining the second training impulse value comprises:

measuring a second intensity of the second physical routine, as performed by the person;

recording a second time duration of the second physical routine, as performed by the person; and calculating the second training impulse value based on the measured second intensity and the recorded second time duration.

6. A method according to claim 1, wherein:

calculating the first response value comprises calculating a ratio of the determined first level of the biochemical marker and the determined first training impulse value; and calculating the second response value comprises calculating a ratio of the determined second level of the biochemical marker and the determined second training impulse value.

7. A method according to claim 1, wherein the first training impulse is determined at a first moment of time and the second training impulse is determined at a second moment of time, and wherein the second moment of time is at least 24 hours apart from the first moment of time but within at least 72 hours from the first moment of time.

8. A method according to claim 5, wherein each of the first time duration and the second time duration is at least 10 minutes.

9. A system for recommending a physical routine to a person, comprising:

a physical sensor configured to measure an intensity of the physical routine;

a biochemical sensor configured to determine a level of a biochemical marker of the person;

a processing arrangement configured to:

measure, via the physical sensor, a first intensity of a first physical routine performed by the person;

determine a first training impulse value corresponding to the first physical routine as performed by the person based, at least in part, on the measured first intensity thereof;

determine, via the biochemical sensor, a first level of a biochemical marker of the person associated with completion of the first physical routine, as performed by the person, wherein the first level of a biochemical marker includes a first ratio of a first level of testosterone to a first level of cortisol;

calculate a first response value for the first physical routine based on the determined first training impulse value and the determined first level of the biochemical marker, wherein calculating the first response value is based on a ratio of the determined first level of the biochemical marker and the determined first training impulse value;

measure, via the physical sensor, a second intensity of a second physical routine performed by the person;

determine a second training impulse value corresponding to the second physical routine as performed by the person based, at least in part, on the measured second intensity thereof;

determine, via the biochemical sensor, a second level of a biochemical marker of the person associated with completion of the second physical routine, as performed by the person, wherein the second level of a biochemical marker includes a second ratio of a second level of testosterone to a second level of cortisol;

calculate a second response value for the second physical routine based on the determined second training impulse value and the determined second level of the biochemical marker, wherein calculating the second response value is based on a ratio of the determined second level of the biochemical marker and the determined second training impulse value;

compare the calculated first response value and the calculated second response value; and recommend one of the first physical routine and the second physical routine for the person based on the comparison.

10. A system according to claim 9, wherein the processing arrangement is further configured to:

record, via the biochemical sensor, a first baseline level of the biochemical marker of the person, the first baseline level being recorded prior to starting of the first physical routine by the person;

record, via the biochemical sensor, a first closing level of the biochemical marker of the person within a predefined time interval after completion of the first physical routine, as performed by the person;

calculate the first level of the biochemical marker based on the recorded first closing level of the biochemical marker and the recorded first baseline level of the biochemical marker;

record, via the biochemical sensor, a second baseline level of the biochemical marker of the person, the second baseline level being recorded prior to starting of the second physical routine by the person;

record, via the biochemical sensor, a second closing level of the biochemical marker of the person within a predefined time interval after completion of the second physical routine, as performed by the person; and calculate the second level of the biochemical marker based on the recorded second closing level of the biochemical marker and the recorded second baseline level of the biochemical marker.

11. A system according to claim 10, wherein the predefined time interval is in a range of 1 minute to 30 minutes.

12. A system according to claim 9, wherein the processing arrangement is further configured to:

record a first time duration of the first physical routine, as performed by the person; and calculate the first training impulse value based on the measured first intensity and the recorded first time duration, and record a second time duration of the second physical routine, as performed by the person; and calculate the second training impulse value based on the measured second intensity and the recorded second time duration.

13. A system according to claim 9, wherein the processing arrangement is further configured to:

calculate the first response value based on a ratio of the determined first level of the biochemical marker and the determined first training impulse value; and calculate the second response value based on a ratio of the determined second level of the biochemical marker and the determined second training impulse value.

14. A system according to claim 9, wherein the first training impulse is determined at a first moment of time and the second training impulse is determined at a second moment of time, and wherein the second moment of time is at least 24 hours apart from the first moment of time but within at least 72 hours from the first moment of time.

15. A system according to claim 12, wherein each of the first time duration and the second time duration is at least 10 minutes.

16. A system according to claim 9, wherein the physical sensor is installed in an electronic device associated with the person.

17. A system according to claim 9, wherein the biochemical sensor is implemented as a lateral flow strip.

18. A computer-program product, having computer-readable instructions stored therein, that when executed by a processing arrangement, cause the processing arrangement to perform method steps according to claim 1.

* * * * *